US005299327A

United States Patent [19]

Wilkerson

[11] Patent Number: 5,299,327

[45] Date of Patent: Apr. 5, 1994

[54] SEWER VENTILATOR SYSTEM FOR RECREATIONAL VEHICLES, BOATS AND THE LIKE

[76] Inventor: Edward M. Wilkerson, 3105 W. Main, Russellville, Ark. 72801

[21] Appl. No.: 898,724

[22] Filed: Jun. 15, 1992

[51] Int. Cl.[5] ..... E03D 9/04

[52] U.S. Cl. ..... 4/213; 4/218

[58] Field of Search ..... 4/213, 211, 218, 347, 4/209

[56] References Cited

U.S. PATENT DOCUMENTS

| | | | |
|---|---|---|---|
| 346,714 | 8/1886 | Boyd | 4/218 |
| 346,715 | 8/1886 | Boyd | 4/218 |
| 1,010,100 | 11/1911 | Wallace | 4/218 |
| 3,571,822 | 3/1971 | Shaw | 4/213 |
| 4,922,557 | 5/1990 | Harding et al. | 4/347 X |

*Primary Examiner*—Charles E. Phillips

*Attorney, Agent, or Firm*—Stephen D. Carver; Jerry L. Mahurin

[57] ABSTRACT

An automatic forced air ventilation system for recreational vehicles, railroad cars or the like designed to be operated during commode flushing The system creates negative pressure in the holding tank to prevent obnoxious odors from back-flowing into the vehicle. The sewer gases are exhausted outside of the vehicle during flushing of the commode. A ventilation fan assembly suctions a vent pipe leading to the sewage holding tank. The fan assembly comprises a tubular header with a fan disposed within. A circuit selectively operates the fan. In the preferred embodiment the tubular header is mounted on the roof of the vehicle over the existing vent pipe. A flange extends from the header and secures the fan assembly to the roof of the vehicle. The fan comprises an impeller of a diameter slightly less than the internal diameter of the header and a direct current motor adapted to operate at the voltage provided by the vehicle. A collar circumscribes the interior of the header forming a sill directly below the impeller. The control circuit comprises a latching relay responsive to at least one of a plurality of isolated sources such as the bathroom light switch, one or more timer switches or microswitches operated by the flushing mechanism, or a movement sensor disposed within the bathroom.

5 Claims, 3 Drawing Sheets

SEWER VENTILATOR SYSTEM FOR RECREATIONAL VEHICLES, BOATS AND THE LIKE

BACKGROUND OF THE INVENTION

The present invention broadly relates to sewer ventilation systems More particularly the present invention comprises a Sewer Ventilator System for Recreational Vehicles, Boats and the Like that automatically exhausts obnoxious sewer gases and prevents them from entering the vehicle.

Conventional recreational vehicles, camper trailers, boats, and the like are frequently equipped with bathrooms. Self-contained sewage storage tanks are provided for temporarily storing waste. Periodically, the wastes must be emptied to designated dump sites. Sewer gases are generated in the holding tank during this time. Although the overpressure is conventionally vented to atmosphere, when the commode is flushed objectionable gases nevertheless enter the vehicle.

When not connected to a source of water, water must be stored and transported. Since water must be rationed, commodes for such vehicles are designed to minimize the water used during flushing. They generally employ various types of trap-doors to release wastes into the holding tank of the system. There is seldom a water trap for preventing sewer gases from flowing back through the flush valve while it is in the open position. Deodorizing chemicals are used in these sewage holding tanks to help combat foul odors. Also, in the near future all railroad passenger cars will be equipped with self-contained sewer gas holding systems.

Numerous previous U.S. Patents have disclosed methods and apparatuses intended to cope with the odors produced by conventional household and "dry" toilet odors. Person U.S. Pat. No. 3,927,429 addresses a deodorizer to be secured to a conventional household toilet. Goodwin, U.S. Pat. No. 4,025,325 speaks to ventilation of commodes by using a portable filtering unit. Anderson U.S. Pat. No. 4,894,872 concerns outdoor toilets such as those used in remote park areas and some rural areas. This invention provides the holding tank of its system with continuous ventilation. Agelatos U.S. Pat. No. 4,944,045 is a ring shaped ventilation system that is adapted to sense and filter odorous air from conventional household toilets.

Many patents have addressed specific problems encountered by recreational vehicles and their sewer systems. Jacabis U.S. Pat. No. 4,699,207 covers ventilation for the interiors of recreational vehicles. Stewart U.S. Pat. No. 4,710,988 pertains to the design of recreational vehicle commodes and the flushing valve mechanism but, fails to speak to ventilation. Sigler U.S. Pat. No. 4,819,279 addresses vacuum toilet systems in the transfer of waste material. Most recreational vehicles do not have vacuum systems. They are generally gravity fed from the commodes to holding tanks. Mercer U.S. Pat. No. 4,841,578 basically addresses the way chemical is added to RV commodes and holding tanks. Largent-Antos U.S. Pat. No. 4,944,048 addresses a portable holding tank for a recreational vehicle commode. It discloses a removable tank for disposal of the sewage.

Also pertinent to the present disclose are U.S. Pat. Nos.: 2,285,581 issued to Horton; 3,609,772 issued to Howard; 4,108,380 issued to Richardson; 4,704,747 issued to Brubakken; 4,805,660 issued to Antos; 4,867,047 issued Citron; and 4,892,039 issued to Sargent.

Known prior art systems for ventilating conventional recreational vehicle sewage storage tanks are deficient. In particular, an adequate system should operate automatically upon activation of the commode trap door. While such devices must be responsive to their own individual switching mechanisms, optionally they should be capable of automatic triggering when the bathroom lights (or other devices) are activated. When the lights are thereafter turned off, the system should run for a predetermined time and then shut down automatically. Such a device must vent the exhaust gases of the aforementioned tank to the ambient atmosphere by placing suction on the tank to prevent the gases from rising through the trap door of the commode when it is opened.

An adequate system must be easy to install, either during manufacture of the vehicle, or during subsequent retrofitting. The system would not need to operate continuously, and it must avoid draining of the vehicle battery. It should be responsive to the water pump associated with many recreational vehicle toilets. Alternatively, the system could be actuated by a micro switch contacted by the flush lever of the toilet. An acceptable system must therefore respond to any of a variety of electrical inputs, and they must be protectively isolated from one another to prevent mutual interference.

SUMMARY OF THE INVENTION

I have developed a forced air ventilation system for recreational vehicles, railroad cars or the like designed to be operated during commode flushing. It is designed to create a negative pressure in the holding tank to prevent obnoxious odors from back-flowing into the vehicle. The sewer gases are exhausted outside of the vehicle during flushing of the commode. This system allows chemical usage in sewage holding tanks to be reduced by up to fifty percent. This is a positive step in helping to eliminate environmental problems.

The forced air mechanical ventilation unit for sewage storage tanks is designed to fit on or in existing or retrofitted vent lines associated with typical recreational vehicle sewage storage tanks. Most recreational vehicles have storage tanks with sewer gas vent lines exiting out through the roof of the vehicle. Currently when a recreational vehicle commode is flushed some of the sewer gases back-flow into the vehicle. My invention eliminates foul odors at the source of the problem. Previous systems vent away foul odors after they become offensive whether in the commode or bathroom, or they try to suppress foul odors with chemicals.

My mechanical sewer gas ventilation systems can be easily installed during construction of new vehicles or retrofitted onto existing units. The cost of my ventilation systems are affordable and the benefits are significant. My system eliminates the need for large quantities of chemicals. My invention is a permanent type low cost, low maintenance ventilation system for both commodes and holding tanks. The commodes in these systems generally operate via a trap door assembly to release wastes into the storage tank.

In the preferred embodiment of the present invention a fan assembly pulls a suction on the vent pipe and thus upon the tank. The fan assembly is primarily comprised of a tubular header with a fan disposed within. A circuit selectively operates the fan. In the preferred embodiment the tubular header is mounted on the roof of the vehicle over the existing or retrofitted vent pipe. A flange extends from the header and secures the fan assembly to the roof of the vehicle.

The header of the system is cylindrical and hollow. The circular mounting flange extends contiguously from the base of the header. A gasket or sealant is disposed between the flange and the roof of the vehicle to seal the system to the vent pipe The rain cap is suspended above and around the header forming an air flow annulus.

The fan is primarily comprised of an impeller of a diameter slightly less than the internal diameter of the header and a direct current motor adapted to operate at the voltage provided by the vehicle. A collar circumscribes the interior of the header forming a sill directly below the impeller. This sill insures that the impeller efficiently draws air from the center of the header preventing turgid air pockets forming around the outer tips of the impeller blades. A bracket secures the motor to the interior of the header.

The circuit supplying power to the motor may be of several types. In the preferred embodiment, the circuit comprises a latching relay that activates the fan in response to signals from at least one of a plurality of sources. The conventional bathroom light switch may be interconnected with the relay through an isolating diode. The circuit further provides power to the fan when the lights are left off and the water demand pump for the sewer system is activated. Thus another diode interconnects the relay to the flushing water pump. A capacitor and diodes provide current to the fan after the light is turned off or the pump shuts off.

An alternative embodiment calls for a microswitch activated by the lever or handle of the commode itself to conduct current to the fan motor. The capacitor allows the fan to run for a time after the flush mechanism is released, by temporarily latching the relay after the remote switches or devices to which it is connected are deactivated. Ideally the fan starts before the flush valve is opened to create a negative pressure in the holding tank and shuts off a few seconds after the flush valve is closed.

An alternative embodiment of the fan system employs a system similar to the one disclosed above, except the fan assembly is disposed in line with the vent pipe itself rather than being mounted on the roof. Upper and lower bushings, couplings or reducers can secure the system to the vent pipe above and below the system. The rain cap would remain on the roof over the vent pipe.

A third embodiment would also be employed in line with the vent pipe. A squirrel cage fan replaces the impeller used in the above disclosed embodiments. An inverted "L" shaped tubular header is employed to house the fan in the horizontal leg. Bushings or couplings are employed to connect the system in line with the vent pipe. A motor is mounted on the external surface of the header with a spindle extending into the header to mount the fan.

Therefore a primary object of the present invention is to provide a sewer ventilator system for recreational vehicles, boats, and the like, to reduce relative pressure within a sewage storage tank there installed to prevent the back flow of sewer gases into the interior of the vehicle.

A related object of the present invention is to vent sewer gases from the sewage storage tank of a recreational vehicle or the like to the ambient atmosphere.

A further related object of the present invention is to place a suction on a sewage storage tank to prevent sewer gases from rising through the trap door of an associated commode when the trap door is open.

Another related object of the present invention is to provide a ventilation system for vehicular sewage storage tanks which may be easily retrofitted to conventional vehicles.

Conversely, an object of the present invention is to provide a sewer ventilator system which may be installed on a vehicle during original manufacture.

Another object of the present invention is to provide a sewer ventilator system for recreational vehicles which need not operate continuously and drain the battery of the vehicle.

As still further object is to provide a ventilation system of the character described that may be automatically activated in response to a variety of signals.

A related object is to enable a ventilation system to respond to multiple independent inputs, while isolating each input from the others.

A related object of the present invention is to provide a sewer ventilator system which will automatically operate upon flushing of the vehicle's commode.

Another object is to enable a ventilation system to respond to multiple independent inputs, while isolating each input from the others.

A related object of the present invention is to provide a sewer ventilation system which will automatically operate upon flushing of the vehicle's commode.

Another object of the present invention is to reduce the amount of chemicals used by vehicular sewage storage tanks.

A related object of the present invention is to provide an environmentally sound method to reduce obnoxious odors within the cabin of a recreational cabin of a recreational vehicle or the like.

A related object of the present invention is to eliminate foul odors produced by recreational vehicles sewage system or the like by eliminating the gases producing the odors without the use of chemicals.

Another object of the present invention is to provide a ventilator system for recreational vehicle sewer systems or the like which is affordable and easy to install.

A still further object of the present invention is to provide a ventilator system for sewage storage tanks which provides maximum air flow for specific fan and electric motor applications.

Yet another object is to provide a sewage holding tank ventilation system of the character described that is ideal for use in railroad cars.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
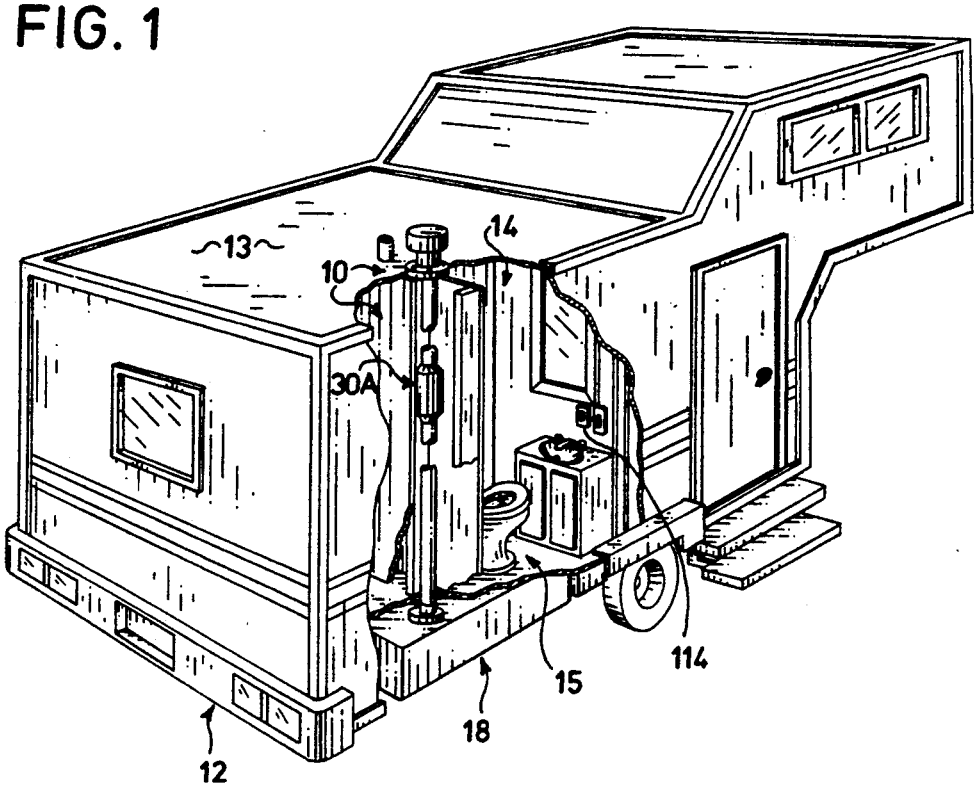
FIG. 1 is a fragmentary perspective view of a typical recreational vehicle upon which our Sewer Ventilator System for Recreational Vehicles, Boats and the Like may be installed.

With reference now directed to the appended drawings, the best mode of my new ventilator system is broadly designated by the reference numeral 10. As indicated above, the ventilator system 10 exhausts gases 11 from sewer storage tanks 18 such as those employed in recreational vehicles 12, boats, railway passenger cars, or similar vehicles. The sewer systems of these vehicles 12 usually have a self-contained commode 15 which operates via a trap door assembly 16 (FIG. 2) to release wastes into the storage tank 18. Ventilator system 10 suctions the interior 17 of holding tank 18 to prevent the rise of sewer gases 11 through the trap door 16 when the commode 15 is flushed.

Frequently the sewage systems in typical recreational vehicles 12 employ an elongated vent pipe of some type extending from the tank 18 through the roof 13 of the vehicle 12. If a holding tank and an associated vent pipe have not been installed on the vehicle or railroad car, a vent pipe 20 of variable length is retrofitted. At one end it is coupled to the tank mounted below via a tank bushing 22, and the other end exits from the vehicle roof.

In the preferred embodiment a fan assembly 30 applies suction to the vent pipe 20 and thus to tank 18. The fan assembly 30 is primarily comprised of a tubular header 40 with a rotatable fan 50 disposed therein. It is activated by a control circuit 100 (FIG. 4) to be described hereinafter in response to predetermined conditions. In the preferred embodiment the tubular header 40 is mounted on the roof 13 of the vehicle 12 over the vent pipe 20. A flange 60 extends from the header 40 and secures the fan assembly 30 to the roof 13 of the vehicle 12.

Figure 2:
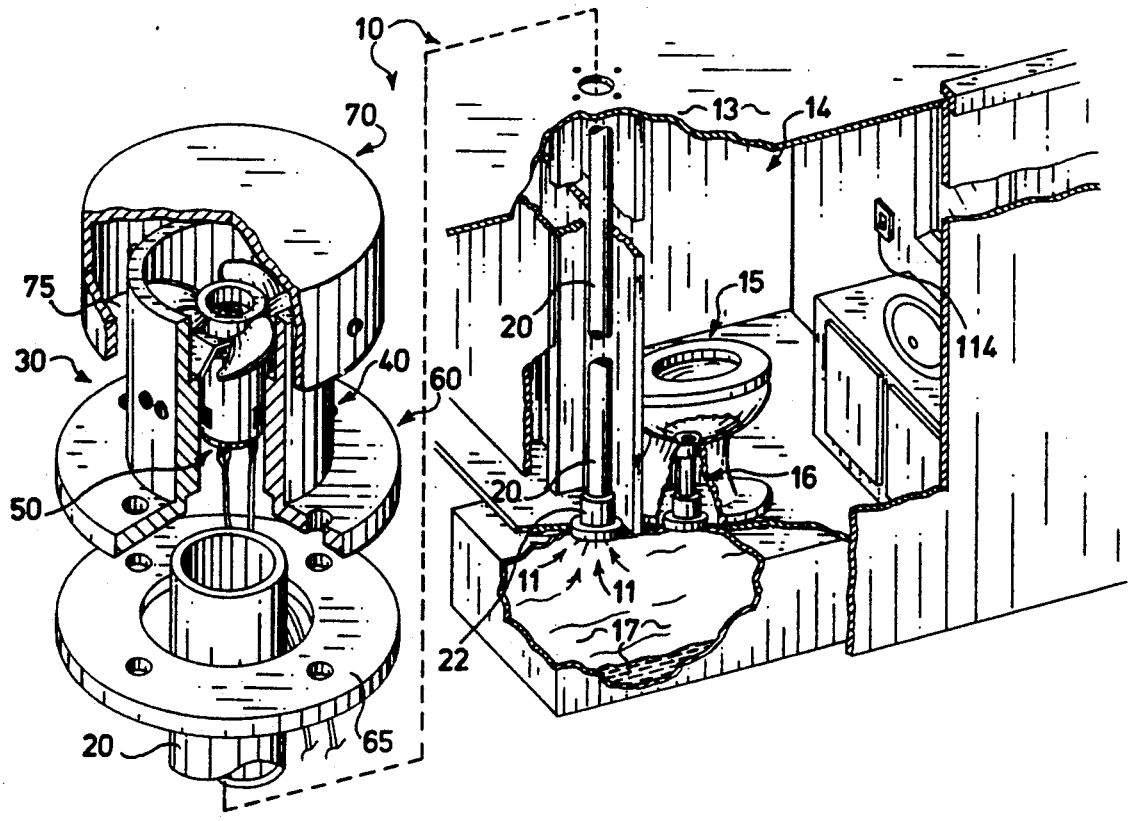
FIG. 2 is a fragmentary, exploded isometric view showing critical portions of the preferred system and related components of the vehicle.
Figure 3:
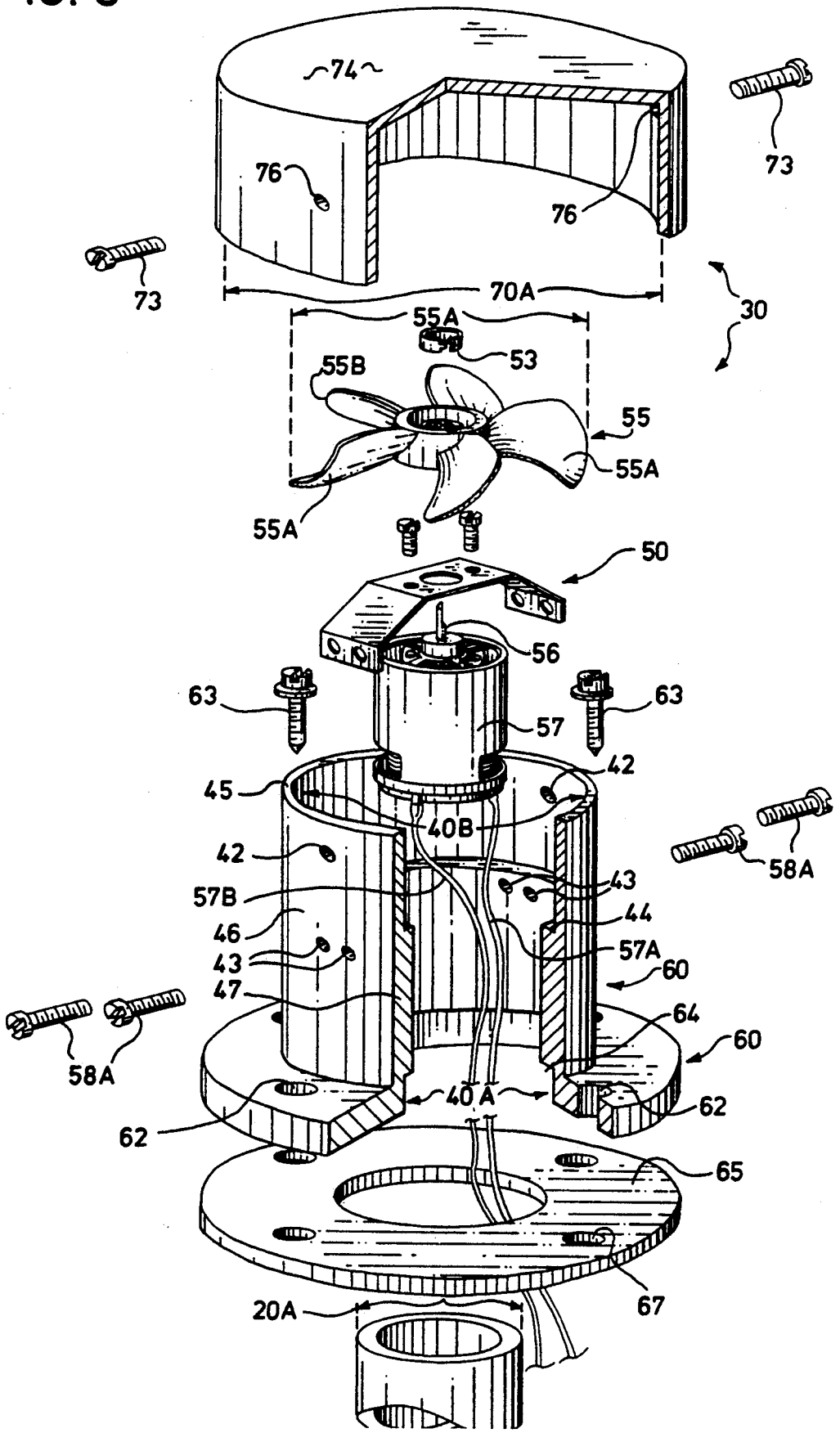
FIG. 3 is an enlarged, exploded isometric view of the preferred exhaust fan system and housing.

Header 40 is cylindrical and hollow. The lower internal diameter 40A of the header is slightly greater than the external diameter 20A of the vent pipe extending from the roof 13 the vehicle 12. The circular mounting flange 60 extends contiguously from the base 41 of the header 40. Mounting holes 62 are defined in the flange 60 to accommodate mounting bolts 63. A gasket 65 defining mounting holes 67 is disposed between the flange 60 and the roof 13 of the vehicle 12 to seal the system 30 to the vent pipe 20. Alternatively, the gasket can be replaced with a bead of silicon sealant or the like. A peripheral internal shoulder 64 circumscribes the point of intersection of the header 40 and the flange 60. The shoulder 64 facilitates sealing by the gasket 65 or sealant. A rain cap 60 is suspended about the header 40. The rain cap 70 is of a diameter 70A greater than the header 40 and has a skirt 72 extending down from its top 74. Rain cap 70 is secured by screws 73 that extend through holes 76 and are received within holes 42 in header 40. The cap 70 is attached in such a manner that a space is left above the top 45 of the header 40 and between the side 46 of the header 40 and the skirt 72 forming an air flow annulus 75 (FIG. 2).

An alternative method of mounting the system 10 to the vent pipe employs replacement of the flange 60 with a bushing. The system can then be directly mounted on the vent pipe 20. The need for a sealing gasket 65 is also eliminated. This method of mounting is particularly useful in retrofitting applications.

The fan 50 is primarily comprised of an impeller 55 of a diameter slightly less than the internal diameter 40B of the header and a direct current motor 57. The motor 57 is adapted to operate at the voltage provided by the vehicle 12, generally twelve volts for gasoline provided by the vehicle 12, generally twelve volts for gasoline powered recreational vehicles and twenty-four volts on diesel powered units. Current is conducted to the motor via wires 57A and 57B which are run into the vehicle 12 outside of the vent pipe 20. A collar 47 circumscribes the interior of the header 40. This collar 47 establishes the shoulder 64 mentioned above and also forms a sill 44 directly below the impeller 55. This sill 44 insures that the impeller 55 efficiently draws air from the center of the header 40 by preventing turgid air pockets forming around the outer tips 55B of the impeller blades 55A. The impeller 55 is secured by a locking clamp 53 to a spindle 56 extending from the motor 57. A rigid bracket 58 is secured the motor 57 to the interior of the header 40. Screws 58A secure bracket 58 to header 40 through holes 43 in the header 40.

Figure 4:
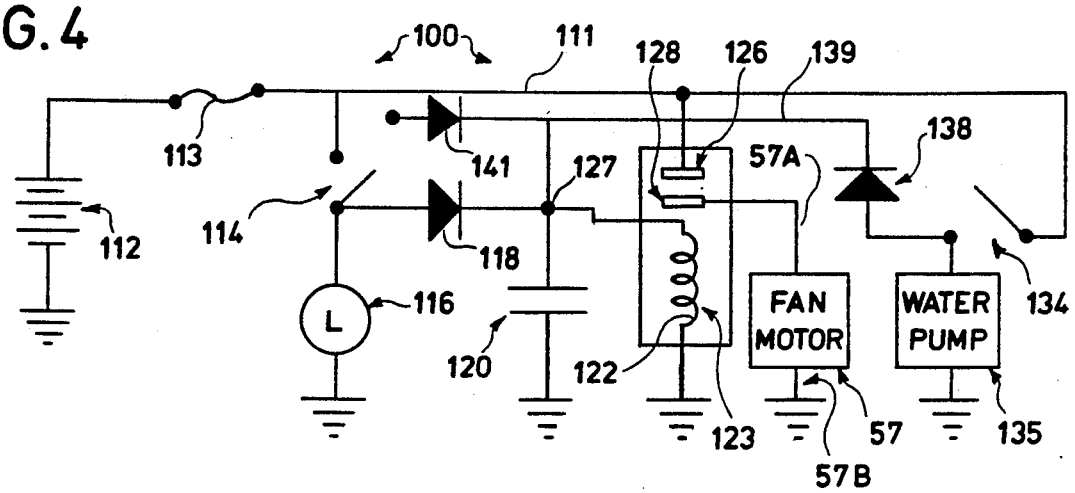
FIG. 4 is an electronic schematic diagram of my preferred circuit system.

The circuit 100 supplying power to the motor may be of several types. The preferred embodiment is illustrated in FIG. 4. The illustrated circuit 100 is protected by a fuse 113 leading to the vehicle battery (or auxiliary battery) 112. The fan motor 57 is ultimately activated by signals derived from external switches or devices. For example, the circuit responds to either the activation of a fan switch, bathroom lights, a timer switch or the energization of the water pump motor, or flushing of commode 15.

A typical bathroom light is schematically designated by the reference numeral 116. It is controlled by a conventional low voltage light switch 114 within the vehicle bathroom 14. When the switch 114 is closed, light 116 is activated. Concurrently current passes through isolating diode 118, charging a latching capacitor 120 and energizing the field 122 of a switching relay 125. Relay contacts 126 and 128 close upon energization of coil 122, and conduct current from line 111 through the fan motor 57 via lines 57A, 57B. Wire 57B connects the motor 57 to a suitable ground on the vehicle chassis or frame.

The preferred circuit 100 is latched to provide a relay feature. Latching capacitor 120 charges as long as node 127 is "high". During capacitive charging, relay 125 will activate the motor 57. When the light switch 114 is opened, as for example, when an occupant exits the bathroom, the capacitor will discharge through the relay field 122 to temporarily maintain relay contacts 126 and 128 closed. Suitable capacitors may have a value between 150 mfd to 2000 mfd. After a preselected time delay, the capacitor is discharged, and the relay then opens its contacts when its field current collapses. The time delay is directly proportional to the value of the capacitor 120.

Node 127 can also be energized by the vehicle's water pump 135 A vehicle switch 134 normally activates the demand pump 135 that supplies water to the commode 15 When node 127 is high, relay coil 122 is energized, and capacitor 120 is charged. Power is applied via isolating diode 138 and line 139. This results in current being supplied to the fan motor 57. Diodes 118 and 138 prevent current stored in the capacitor 120 from discharging to the water pump 135 or the bathroom light 116 after the respective switches 114 or 134 are opened. More importantly, they isolate the water pump from the bathroom lights; as a result, when a user switches on the water pump, the bathroom lights will not activate An alternative embodiment calls for a microswitch activated by the lever or handle of the commode 15 itself to conduct current to the fan motor. In this alternative embodiment, the microswitch (or any other desired device) may be connected to auxiliary isolating diode 141 to activate the circuit in the above described manner. For example, when a conventional movement sensor that detects movements within the bathroom, for example, is outputted to diode 141, the circuit will be activated as described.

Figure 5:
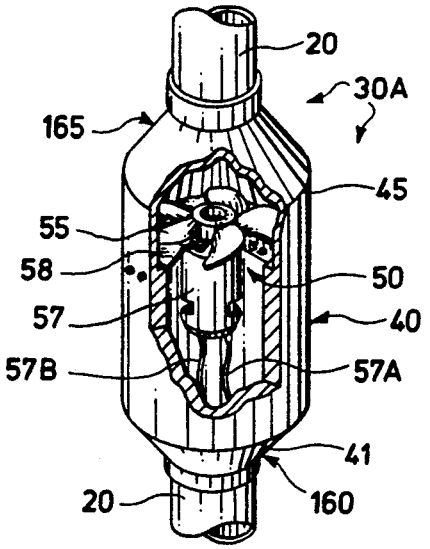
FIG. 5 is a fragmentary, isometric view of an alternative embodiment of the fan system; and, FIG. 6 is a fragmentary isometric view of a second alternative embodiment of the fan system.

An alternative embodiment of the fan system 30A is illustrated in FIGS. 1 and 5 It employs a system 10 similar to the one disclosed above, except the fan assembly 30A is disposed in line with the vent pipe 20 itself rather than being mounted on the roof 13. The rain cap 60 would be disposed on the aforedescribed system would be deployed within the vehicle 12 in line with the vent pipe 20 (FIG. 1). The flange 60 would be replaced with a reducer or coupling 160 extending from the base 41 of the header 40 and another reducer or coupling 165 would be disposed about the upper end 45 of the header 40. These upper and lower reducers 160 and 165 would secure the system 30A to the vent pipe 20 above and below the system 30A.

Figure 6:
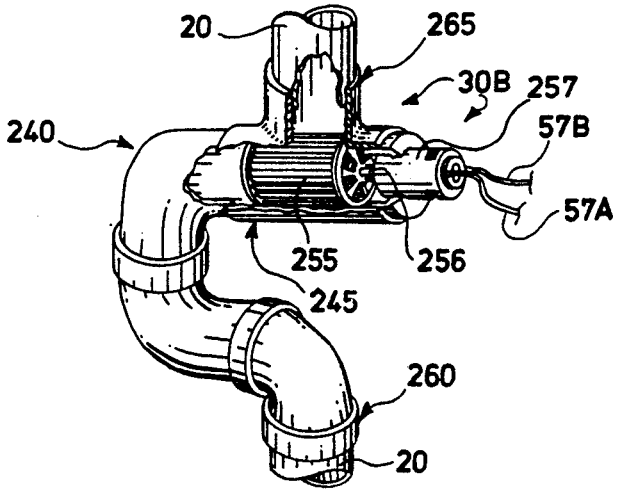

A third embodiment 30B would also be employed in line with the vent pipe 20, (FIG. 6). In this embodiment a squirrel cage fan 255 replaces the impeller 55 used in the above disclosed embodiments 30 and 30A. To accommodate the higher air volume capacity, squirrel cage fan 255 an inverted "L" shaped tubular header 240 is employed to house the fan 255. The fan 255 is disposed in the horizontal leg 245 of the inverted "L". Couplings 260 and 265 are again employed to connect the system 30B in line with the vent pipe 20. A motor 257 is mounted on the external surface of the header 240 with a spindle 256 extending into the horizontal leg 245 of the header 240 to mount the fan 255 This embodiment 30B is particularly well suited for installation of sewage storage systems in railroad cars. It is also ideal for use as original equipment in recreational vehicles 12.

In operation, the ventilator system 10 is energized by a main switch 114 for the bathroom 14 of the recreational vehicle 12 or by other means. Alternatively, when the commode 15 is flushed a microswitch is actuated activating the fan motor 58 or 258. The fan 50 draws a partial vacuum on the tank 18 preventing the rise of sewer gases 11 when the trap door 16 of the commode 15 opens. This eliminates the release of foul odors into the cabin 19 of the vehicle 12.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A ventilator system for exhausting gases from sewage storage tanks of the type employed upon recreational vehicles, boats or the like that have bathrooms equipped with flushable commodes, a bathroom light electrical switch, and a water demand pump, said system comprising:

an elongated vent pipe of variable length having one end attached to said sewage storage tank in fluid flow communication with the interior thereof and an opposite external end passing through a roof of said vehicle, boat or the like to exhaust gas exteriorly thereof;

fan means for suctioning said vent pipe and thus said tank, said fan means comprising a rotatable fan and a motor for driving said fan;

circuit means adapted to be electrically interconnected with a source of electrical power supplied by said vehicle, boat or the like for selectively supplying current to said fan motor to operate said system, said circuit means comprising:

relay means for activating said fan motor, said relay means comprising electrical contacts that normally isolate said fan motor from said electrical power but that selectively switch operating current to said fan motor, said relay means comprising a field for closing said contacts;

a plurality of electrically isolated activating inputs for energizing said relay means without interfering with one another, said isolated activating inputs comprising a first diode for powering said field when said bathroom light electrical switch in said vehicle, boat or the like is activated, and a second diode for powering said field without turning on said bathroom light, said second diode being interconnected with said water demand pump in said vehicle, boat or the like for activation by same;

capacitive means electrically connected to said field for temporarily latching said relay means to make said system stay on only a preselected time interval after said bathroom light switch or said water demand pump are turned off; and, whereby sewer gases are automatically exhausted from said vehicle boat or the like whenever said circuit means is activated without forcing the user to separately turn on or turn off the system.

2. The system as defined in claim 1 wherein said plurality of electrically isolated activating inputs for energizing said relay means comprises a third isolating diode responsive to flushings of the commode in said vehicle, boat or the like for activating said circuit means without turning on either said bathroom light or said water demand pump.

3. The system as defined in claim 1 wherein:

said fan means comprises a tubular header having a predetermined internal diameter and a base adapted to be secured to said roof for mounting said fan means concentrically with respect to said vent pipe, said header coupled to said vent pipe external end, wherein both said fan and said motor are disposed generally coaxially within said header; and, said fan comprises an impeller of a diameter slightly less than said internal diameter of said header; and, said header comprises a reduced diameter internal collar integral with said header having a sill disposed beneath said impeller for increasing exhaust passage efficiency by preventing air pockets from forming around the impeller.

4. The system as defined in claim 3 wherein said fan means further comprises:

a circular mounting flange integral with said base and adapted to be secured to said roof for mounting said fan means concentrically with respect to said vent pipe;

an offset, concentric interior shoulder forming a bathroom of said collar spaced apart from said sill for receiving and abutting sad vent pipe;

a rain cap concentrically disposed above said header, said rain cap comprising a top having a diameter greater than the diameter of said header, and a peripheral skirt extending circumferentially and downwardly around the perimeter of said top; and, a rain resistant gas flow annulus being coaxially formed between said header and said skirt.

5. The system as defined in claim 4 wherein said plurality of electrically isolated activating inputs for energizing said relay means comprises a third isolating diode responsive to flushings of the commode in said vehicle, boat or the like for activating said circuit means without turning on either said bathroom light or said water demand pump.

* * * * *